US009170012B2

(12) United States Patent
Huang

(10) Patent No.: US 9,170,012 B2
(45) Date of Patent: Oct. 27, 2015

(54) HEAT SINK MODULE AND OMNIDIRECTIONAL LED LAMP HOLDER ASSEMBLY USING SAME

(71) Applicant: Tsung-Hsien Huang, I-Lan Hsien (TW)

(72) Inventor: Tsung-Hsien Huang, I-Lan Hsien (TW)

( * ) Notice: Subject to any disclaimer, the term of this patent is extended or adjusted under 35 U.S.C. 154(b) by 114 days.

(21) Appl. No.: 13/875,524

(22) Filed: May 2, 2013

(65) Prior Publication Data

US 2014/0218932 A1 Aug. 7, 2014

(30) Foreign Application Priority Data

Feb. 5, 2013 (CN) ..... 2013 1 0045262

(51) Int. Cl.

| | |
|---|---|
| ***F21V 29/00*** | (2015.01) |
| ***F21K 99/00*** | (2010.01) |
| ***F21V 29/71*** | (2015.01) |
| ***F21V 29/77*** | (2015.01) |
| *F21V 3/00* | (2015.01) |
| *F21Y 101/02* | (2006.01) |
| *F21Y 111/00* | (2006.01) |

(52) U.S. Cl.

CPC ..... *F21V 29/2206* (2013.01); *F21K 9/135* (2013.01); *F21V 29/713* (2015.01); *F21V 29/773* (2015.01); *F21V 3/00* (2013.01); *F21Y 2101/02* (2013.01); *F21Y 2111/007* (2013.01)

(58) Field of Classification Search

CPC ..... F21K 9/135; F21K 9/175; F21K 9/90; F21V 29/773; F21V 29/2206; F21V 29/713; F21V 3/00; F21Y 2101/02; F21Y 2111/007; H01K 1/58; H05B 31/0042; B21C 23/00; B21C 25/00; B21C 27/00; B21C 37/00

USPC ..... 362/294, 373, 218, 800, 650

See application file for complete search history.

(56) References Cited

U.S. PATENT DOCUMENTS

| | | | | |
|---|---|---|---|---|
| 6,719,446 | B2 * | 4/2004 | Cao | 362/547 |
| 2010/0096992 | A1 * | 4/2010 | Yamamoto et al. | 315/112 |
| 2011/0080096 | A1 * | 4/2011 | Dudik et al. | 315/112 |
| 2011/0215700 | A1 * | 9/2011 | Tong et al. | 313/46 |
| 2011/0221323 | A1 * | 9/2011 | Huang | 313/46 |
| 2012/0181913 | A1 * | 7/2012 | Hung et al. | 313/46 |

FOREIGN PATENT DOCUMENTS

DE 202012104124 A1 * 11/2012 ..... F29V 21/00

* cited by examiner

*Primary Examiner* — Sean Gramling
*Assistant Examiner* — Omar Rojas Cadima
(74) *Attorney, Agent, or Firm* — Pai Patent & Trademark Law Firm; Chao-Chang David Pai

(57) ABSTRACT

An omnidirectional LED lamp holder assembly includes a heat sink module including a heat sink base and radiation fins around the heat sink base, a lampshade and an electrical connector respectively mounted at opposing top and bottom sides of the heat sink module. The heat sink base is a one-piece extruded member defining a tubular heat-transfer base portion, a broad platform and a hollow protruding mount for holding LED chips at different angles. The broad platform horizontally protrudes over the periphery of the tubular heat-transfer base portion, providing a bearing face. The radiation fins are fastened to respective mounting grooves around the periphery of the tubular heat-transfer base portion. Waste heat produced during operation of the LED chips can be rapidly transferred by the hollow protruding mount to the broad platform and the heat-transfer base portion and then dissipated by the radiation fin into the outside open air.

13 Claims, 9 Drawing Sheets

HEAT SINK MODULE AND OMNIDIRECTIONAL LED LAMP HOLDER ASSEMBLY USING SAME

BACKGROUND OF THE INVENTION (a) Field of the Invention

The present invention relates to LED lamp technology and more particularly to a heat sink module and an omnidirectional LED lamp holder assembly using the heat sink module.

(b) Description of the Prior Art

For the advantage of low power consumption, LED lamps have been gradually used to substitute for conventional tungsten lamp bulbs. However, LED performance largely depends on the ambient temperature of the operating environment. During the operation of a LED lamp, waste heat must be quickly dissipated. Conventional LED lamps commonly have the LED chips arranged at the front side to emit light forward. With this arrangement, the light intensity at the border area may be weak. With continuing development of lighting technology, LED lamps capable of emitting light in different directions are created. However, because a large number of LED chips are used in a LED lamp, the temperature inside the lamp rises quickly with the operation of the LED lamp, and the LED chips can easily be damaged by heat. Thus, the heat dissipation problem is serious.

A conventional LED lamp capable of emitting light in different directions is known comprises a rectangular heat-transfer prism and a plurality of radiation fins radially arranged around one end of the rectangular heat-transfer prism. The other end of the rectangular heat-transfer prism is a heat absorbing end shaped like a rectangular table. LED chips are mounted at the end face and side faces of the heat absorbing end of the rectangular heat-transfer prism for emitting light in different directions. However, the rectangular heat-transfer prism is a solid prism that cannot dissipate heat rapidly and does not allow arrangement of wires therein. Further, the cost of the rectangular heat-transfer prism is high. The mounting arrangement between the radiation fins and the rectangular heat-transfer prism is not stable.

There is known another conventional LED lamp design, which comprises a heat-transfer base block, a heat-transfer component connected to the heat-transfer base block and providing multiple mounting faces at different angles, a plurality of radiation fins radially arranged around the heat-transfer base block, and a plurality of LED chips arranged on the mounting faces of the heat-transfer component. According to this design, as the heat-transfer base block and the heat-transfer component are two separate members fastened together, waste heat cannot be fully and rapidly transferred by the heat-transfer component from the LED chips to the heat-transfer base block, and the heat dissipation efficiency is low. Further, this design complicates the fabrication.

There is known still another conventional LED lamp design, which uses a heat sink made by a stretch forming technique. This design of heat sink cannot effectively match the radiation fins for heat dissipation. Further, the wall thickness of the heat sink cannot be freely adjusted to fit the power of the LED chips to be used. Thus, materials of different wall thicknesses should be prepared to fit different application requirements, thus complicating the fabrication and increasing the cost.

SUMMARY OF THE INVENTION

The present invention has been accomplished under the circumstances in view. It is the main object of the present invention to provide a heat sink module and an omnidirectional LED lamp holder assembly using the heat sink module, wherein the omnidirectional LED lamp holder assembly comprises a heat sink module, a lampshade and an electrical connector. The lampshade is mounted at the top side of the heat sink module. The electrical connector is mounted at the bottom side of the heat sink module. The heat sink module comprises a heat sink base and a plurality of radiation fins mounted around the heat sink base. The heat sink base is a one-piece extruded member comprising a tubular heat-transfer base portion, a broad platform and a hollow protruding mount for the mounting of LED chip. The broad platform is integrally connected to one end of the tubular heat-transfer base portion, defining a bearing face that protrudes horizontally over the periphery of the tubular heat-transfer base portion. The hollow protruding mount is integrally connected to and upwardly extended from a top center area of the broad platform. The hollow protruding mount comprises a horizontal top wall, and a plurality of upright sidewalls connected between the periphery of the horizontal top wall and the broad platform at different angles and defining with the horizontal top wall a cavity. The tubular heat-transfer base portion defines therein a tubular chamber disposed in communication with the cavity, and a plurality of longitudinal mounting grooves equally spaced around the periphery thereof. The radiation fins are respectively and radially fastened to the longitudinal mounting grooves of the tubular heat-transfer base portion. The one-piece design of the heat sink base facilitates the fabrication of the heat sink module. Further, wall thickness of different parts of the heat sink base can be selectively configured according to the power of the LED chips to be used. Thus, waste heat produced during operation of the LED chips can be rapidly transferred by the hollow protruding mount to the broad platform and the heat-transfer base portion, and then dissipated into the outside open air by the radiation fins. Further, the longitudinal mounting grooves are simultaneously formed on the periphery of said tubular heat-transfer base portion upon extrusion of said heat sink base to form said tubular heat-transfer base portion, said broad platform and said hollow protruding mount.

Further, the heat-transfer base portion and the horizontal top wall and upright sidewalls of the hollow protruding mount can be made to have different wall thicknesses according to arrangement of LED chips in order to facilitate quick heat dissipation. Preferably, the wall thickness of the heat-transfer base portion is smaller than the wall thickness of the horizontal top wall of the hollow protruding mount and the wall thickness of the upright sidewalls of the hollow protruding mount.

In one embodiment of the present invention, the broad platform comprises an annular retaining groove extending around the periphery thereof, and the lampshade comprises an annular mounting rib protruding from an inside wall thereof and engaged into the annular retaining groove of the broad platform.

In another embodiment of the present invention, the lampshade comprises an annular groove extending around the periphery thereof, and the radiation fins each comprise a retaining protruding portion. The retaining protruding portions of the radiation fins constitute an interrupted flange around the radiation fins and engaged into the annular groove of the lampshade.

Further, each radiation fin is configured to provide a step at an inner upper side thereof. Further, the bearing face of the broad platform is supported on the steps of the radiation fins and a gap is defined between the top wall of the broad platform and the retaining protruding portions of the radiation fins. Further, the lampshade defines a bottom wall at a bottom side of the annular groove thereof and press-fitted into the gap.

Further, in one embodiment of the present invention, the electrical connector is fastened to the tubular heat-transfer base portion. In this embodiment, the tubular heat-transfer base portion comprises an annular groove extending around an inside wall thereof, and an anti-rotation groove having one end thereof extending across the annular groove of the tubular heat-transfer base portion and an opposite end thereof extending to a bottom edge of the tubular heat-transfer base portion. Further, the electrical connector comprises a top opening, a plurality of hook rods and an anti-rotation rod arranged around the top opening. Each hook rod has the top end thereof terminating in an outer hook portion and hooked in the annular groove of the tubular heat-transfer base portion. Further, the anti-rotation rod is engaged into the anti-rotation groove of the tubular heat-transfer base portion.

In another embodiment of the present invention, the electrical connector is fastened to the radiation fins. In this embodiment, each radiation fin defines a retaining notch at an outer lower side thereof. Further, the electrical connector comprises a top opening, and a plurality of hook rods arranged around said top opening. Each hook rod has the top end thereof terminating in an inner hook portion and hooked in the retaining notch of one respective radiation fin.

DETAILED DESCRIPTION OF THE PREFERRED EMBODIMENTS

FIGS. 1-5 illustrate an omnidirectional LED lamp holder assembly in accordance with a first embodiment of the present invention. The omnidirectional LED lamp holder assembly 100 comprises a heat sink module 10, a lampshade 20, and an electrical connector 30.

Figure 8:
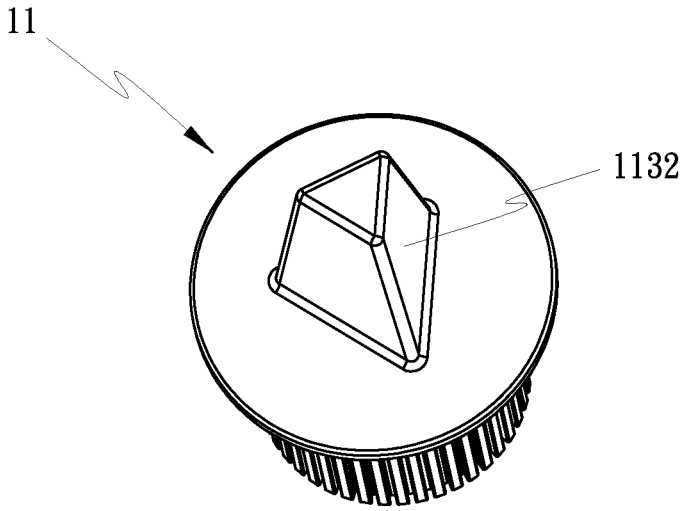
FIG. 8 is a top elevational view of an alternate form of the heat sink base in accordance with the present invention.

The heat sink module 10 comprises a heat sink base 11 and a plurality of radiation fins 12 radially mounted around the heat sink base 11. The heat sink base 11 is an extruded one piece member comprising a tubular heat-transfer base portion 111, a broad platform 112 located at the top side of the tubular heat-transfer base portion 111, and a hollow protruding mount 113 raised from the center area of the top wall of the broad platform 112 for the mounting of LED chips (not shown). The broad platform 112 has its bottom wall connected to the top side of the tubular heat-transfer base portion 111. The peripheral edge of the broad platform 112 horizontally protrudes over the periphery of the tubular heat-transfer base portion 111, providing a bearing face 1121. The hollow protruding mount 113 is formed integral with the center area of the top wall of the broad platform 112, defining a polygonal horizontal top wall 1131 and a plurality of sidewalls 1132 connected between the peripheral edge of the polygonal horizontal top wall 1131 and the top wall of the broad platform 112 at different angles. In this embodiment, the horizontal top wall 1131 is a hexagonal wall, and therefore there are six sidewalls 1132 connected between the horizontal top wall 1131 and the top wall of the broad platform 112 at six sides. However, this configuration is not a limitation. In an alternate form of the present invention, as shown in FIG. 8, the horizontal top wall 1131 is a triangular wall, and therefore there are three sidewalls 1132 connected between the horizontal top wall 1131 and the top wall of the broad platform 112 at three sides. Further, the horizontal top wall 1131 and the sidewalls 1132 surround a cavity 1133 that is kept in communication with a tubular chamber 1111 defined in the heat-transfer base portion 111. The heat-transfer base portion 111 defines a plurality of longitudinal mounting grooves 1112 equally spaced around the periphery thereof. The radiation fins 12 are respectively radially fastened to the longitudinal mounting grooves 1112 of the heat-transfer base portion 111. The longitudinal mounting grooves 1112 can be simultaneously formed upon extrusion of the heat sink base 11, so as to facilitate the fabrication. Alternatively, a secondary processing process can be employed to make the mounting grooves on the heat-transfer base portion 111 after extrusion of the tubular heat-transfer base portion 111 (yet without mounting grooves), the broad platform 112 and the hollow protruding mount 113 of the heat sink base 11. Further, a lathing process is employed to make an annular groove 1113 and an anti-rotation groove 1114 on the inside wall of the tubular heat-transfer base portion 111. The anti-rotation groove 1114 has its one end extending across the annular groove 1113 and its other end extending to the bottom edge of the tubular heat-transfer base portion 111. The electrical connector 30 is inserted with its top side into the tubular heat-transfer base portion 111, and forced into engagement with the annular groove 1113 and the anti-rotation groove 1114. Further, a lathing process is employed to make an annular retaining groove 1122 around the peripheral edge of the broad platform 112 for the mounting of the lampshade 20.

Because the heat sink base 11 is a one-piece extruded member, the wall thickness D1 of the tubular heat-transfer base portion 111, and the wall thickness D2 of the top wall 1131 and sidewalls 1132 of the hollow protruding mount 113 can be selectively configured according to the power of the LED chips to be used. Further, in order to enhance the heat dissipation efficiency, the wall thickness D1 of the tubular heat-transfer base portion 111 can be smaller than the wall thickness D2 of the top wall 1131 and sidewalls 1132 of the hollow protruding mount 113. In this case, the hollow protruding mount 113 can rapidly transfer waste heat from the installed LED chips to the tubular heat-transfer base portion 111 for quick dissipation into the outside open air through the radiation fins 12.

Further, the lampshade 20 is mounted at the top side of the heat sink module 10, having an annular mounting rib 21 located at the inside wall thereof and forced into engagement with the annular retaining groove 1122 of the broad platform 112.

Further, the electrical connector 30 is mounted at the bottom side of the heat sink module 10. The electrical connector 30 comprises a top opening 31, a plurality of hook rods 32 and an anti-rotation rod 33 arranged around the top opening 31. The anti-rotation rod 33 is forwardly offset in the transverse direction (the direction of the wall thickness) relative to the hook rods 32 so that the anti-rotation rod 33 can be engaged into the anti-rotation groove 1114 upon insertion of the electrical connector 30 into the bottom side of the tubular heat-transfer base portion 111. Further, each hook rod 32 has a top end thereof terminating in an outer hook portion 321. After insertion of the electrical connector 30 into the bottom side of the tubular heat-transfer base portion 111, the outer hook portions 321 of the hook rods 32 and the anti-rotation rod 33 are respectively engaged into the annular groove 1113 and the anti-rotation groove 1114 of the tubular heat-transfer base portion 111, thus prohibiting relative rotation and axial displacement between the electrical connector 30 and the tubular heat-transfer base portion 111.

Thus, after installation of LED chips in the top wall 1131 and sidewalls 1132 of the tubular heat-transfer base portion 111, the LED chips emit light in various different directions, and the waste heat thus produced during the operation of the LED chips can be quickly transferred through the hollow protruding mount 113, the heat-transfer base portion 111 and the broad platform 112 to the radiation fins 12 and then dissipated into the outside open air by the radiation fins 12.

Figure 1:
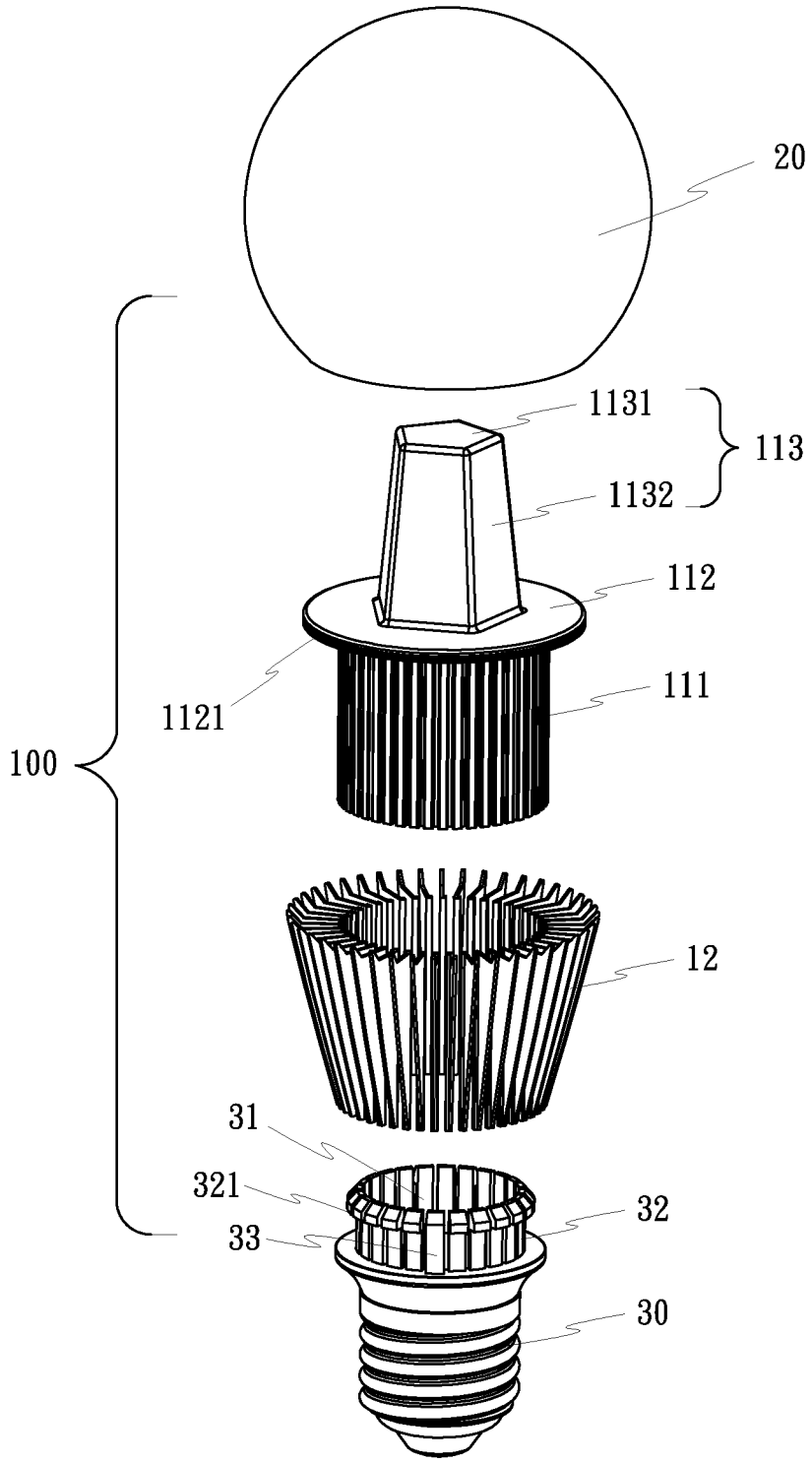
FIG. 1 is an exploded view of an omnidirectional LED lamp holder assembly in accordance with a first embodiment of the present invention.
Figure 2:
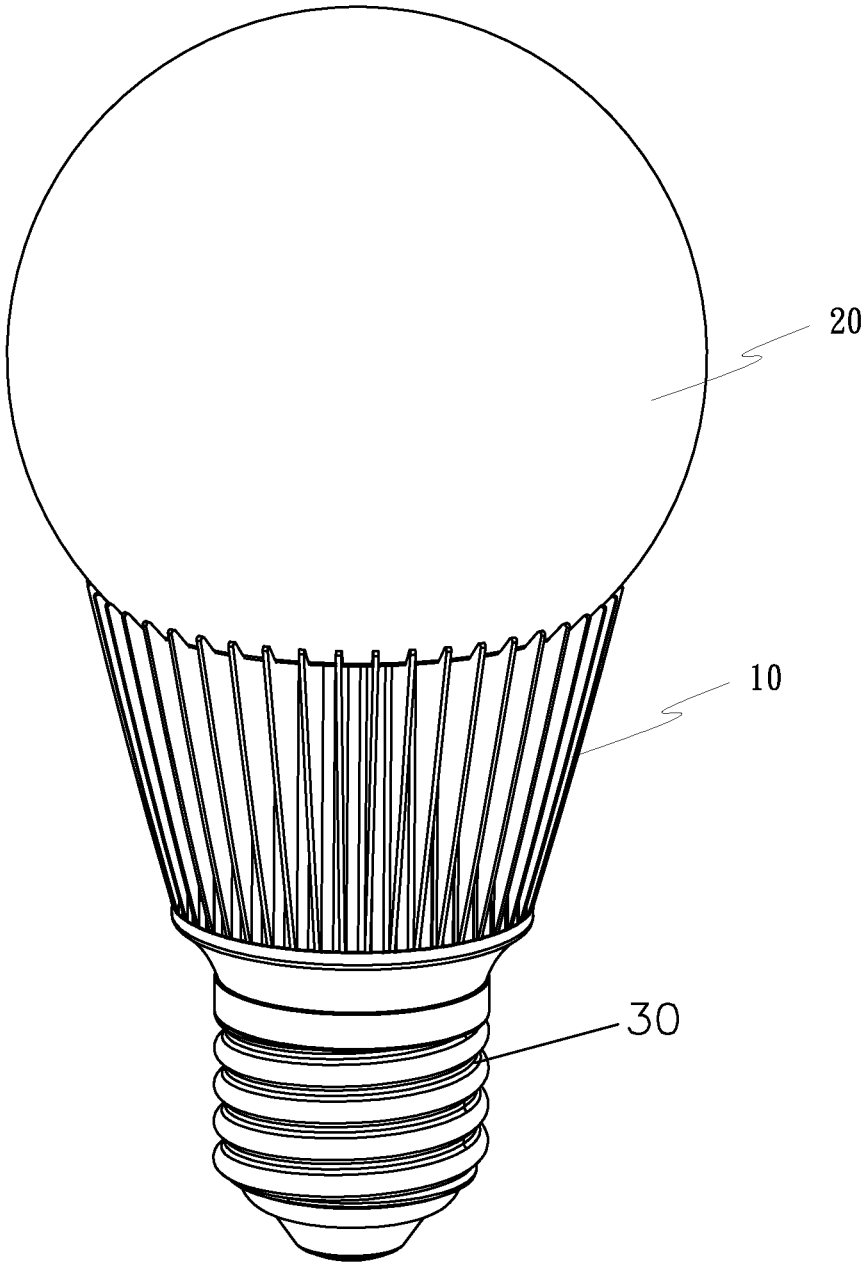
FIG. 2 is an oblique top elevational view of the omnidirectional LED lamp holder assembly in accordance with the first embodiment of the present invention.
Figure 3:
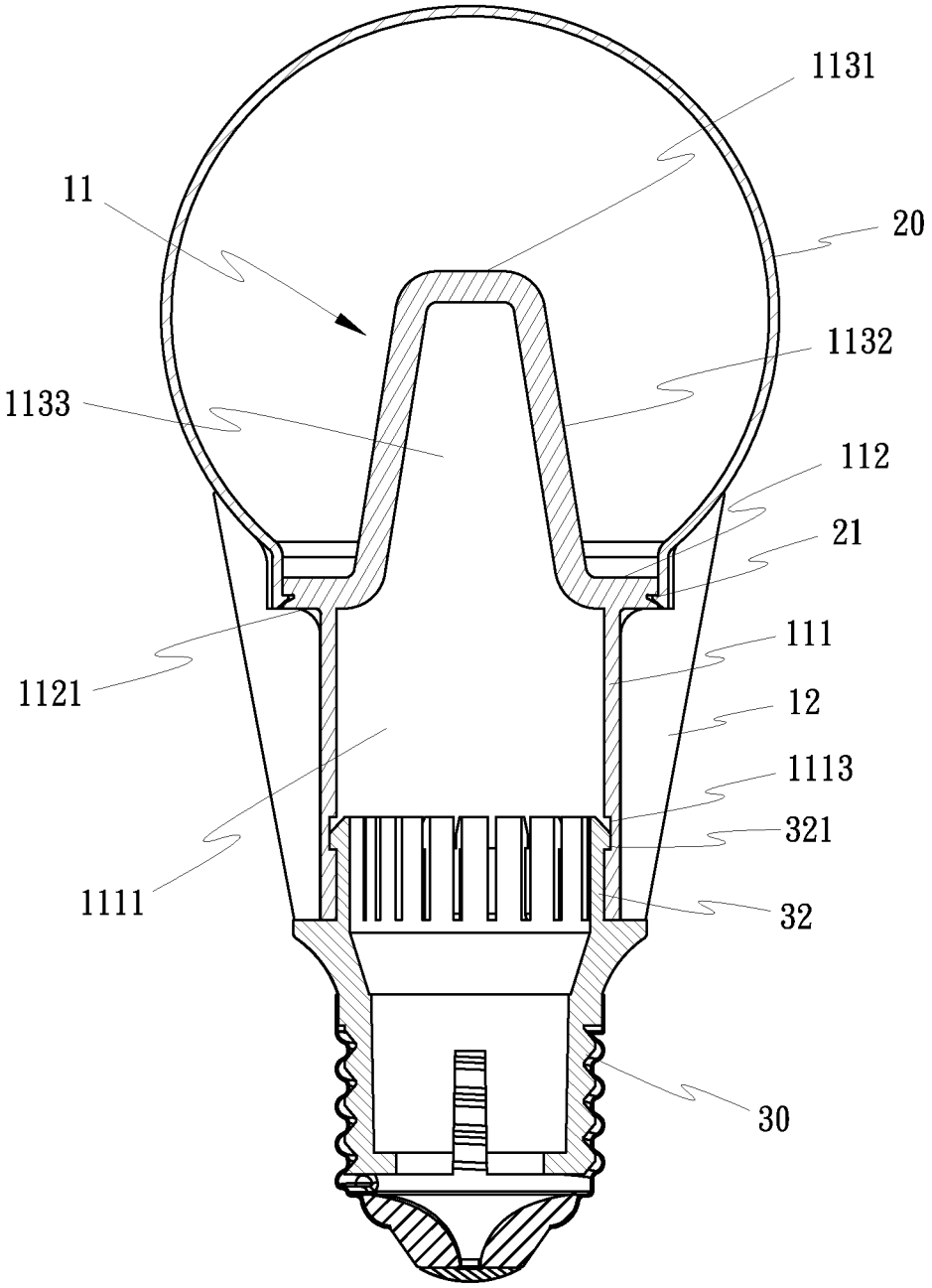
FIG. 3 is a schematic sectional side view of the omnidirectional LED lamp holder assembly in accordance with the first embodiment of the present invention.
Figure 4:
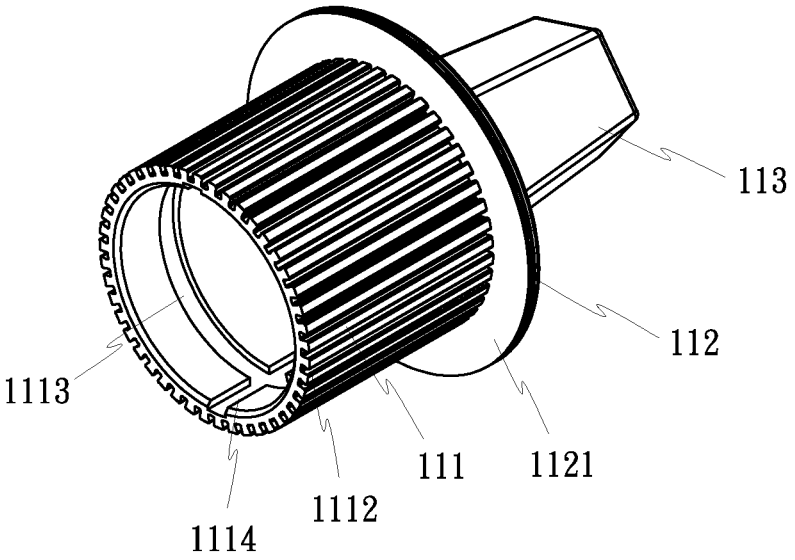
FIG. 4 is an elevational view of the heat sink base of the omnidirectional LED lamp holder assembly in accordance with the first embodiment of the present invention.
Figure 5:
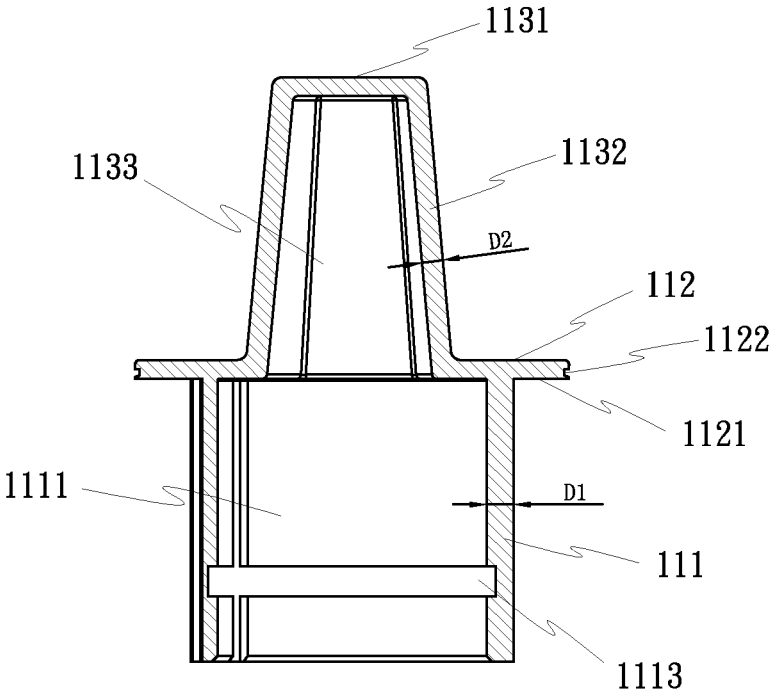
FIG. 5 is a schematic sectional view of the heat sink base of the omnidirectional LED lamp holder assembly in accordance with the first embodiment of the present invention.
Figure 6:
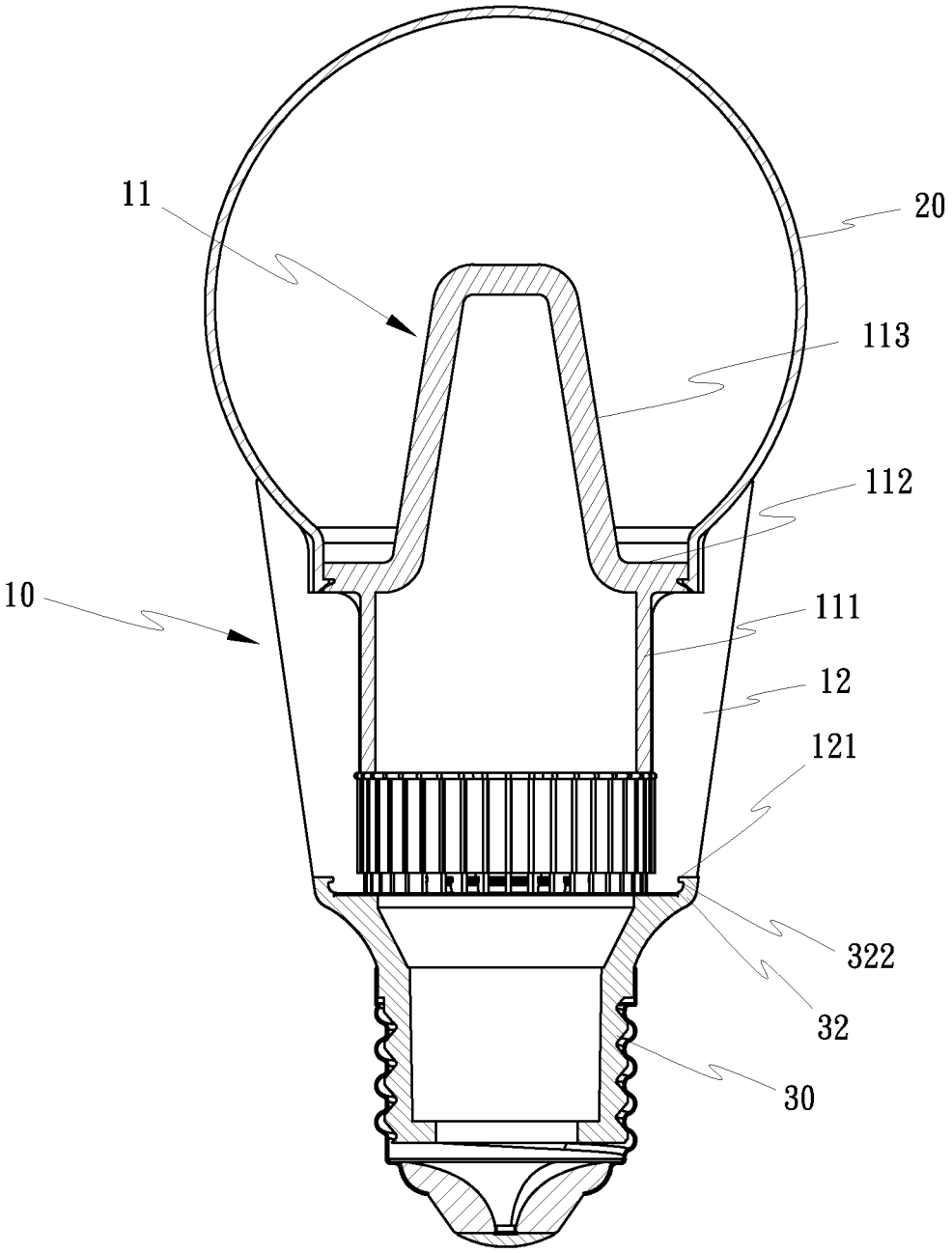
FIG. 6 is a schematic sectional view of an omnidirectional LED lamp holder assembly in accordance with a second embodiment of the present invention.
Figure 7:
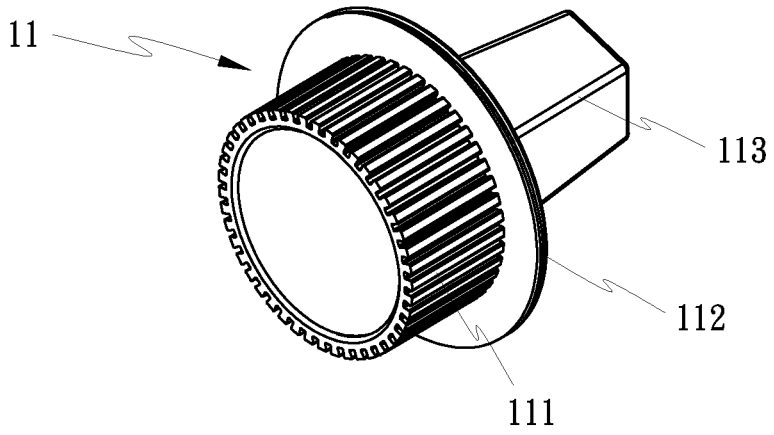
FIG. 7 is an elevational view of the heat sink base of the omnidirectional LED lamp holder assembly in accordance with the second embodiment of the present invention.

FIGS. 6 and 7 illustrate an omnidirectional LED lamp holder assembly in accordance with a second embodiment of the present invention. This second embodiment is substantially similar to the aforesaid first embodiment with the exception that the electrical connector 30 is fastened to the radiation fins 12 at the bottom side. According to this second embodiment, each radiation fin 12 defines a retaining notch 121 at an outer bottom side thereof; each hook rod 32 of the electrical connector 30 has the top end thereof terminating in an inner hook portion 322. During installation, the inner hook portions 322 of the hook rods 32 of the electrical connector 30 are respectively forced into engagement with the retaining notches 121 of the radiation fins 12. Further, in this second embodiment, the heat sink module 10 is a one-piece extruded member, i.e., the tubular heat-transfer base portion 111, the broad platform 112 and the hollow protruding mount 113 are formed integrally. Because the electrical connector 30 is directly fastened to the radiation fins 12, the tubular heat-transfer base portion 111 of the heat sink base 11 of the heat sink module 10 in accordance with this second embodiment can be made relatively shorter than that of the aforesaid first embodiment. The connection structure between the lampshade 20 and the heat sink module 10 in accordance with this second embodiment is the same as the aforesaid first embodiment.

Figure 9:
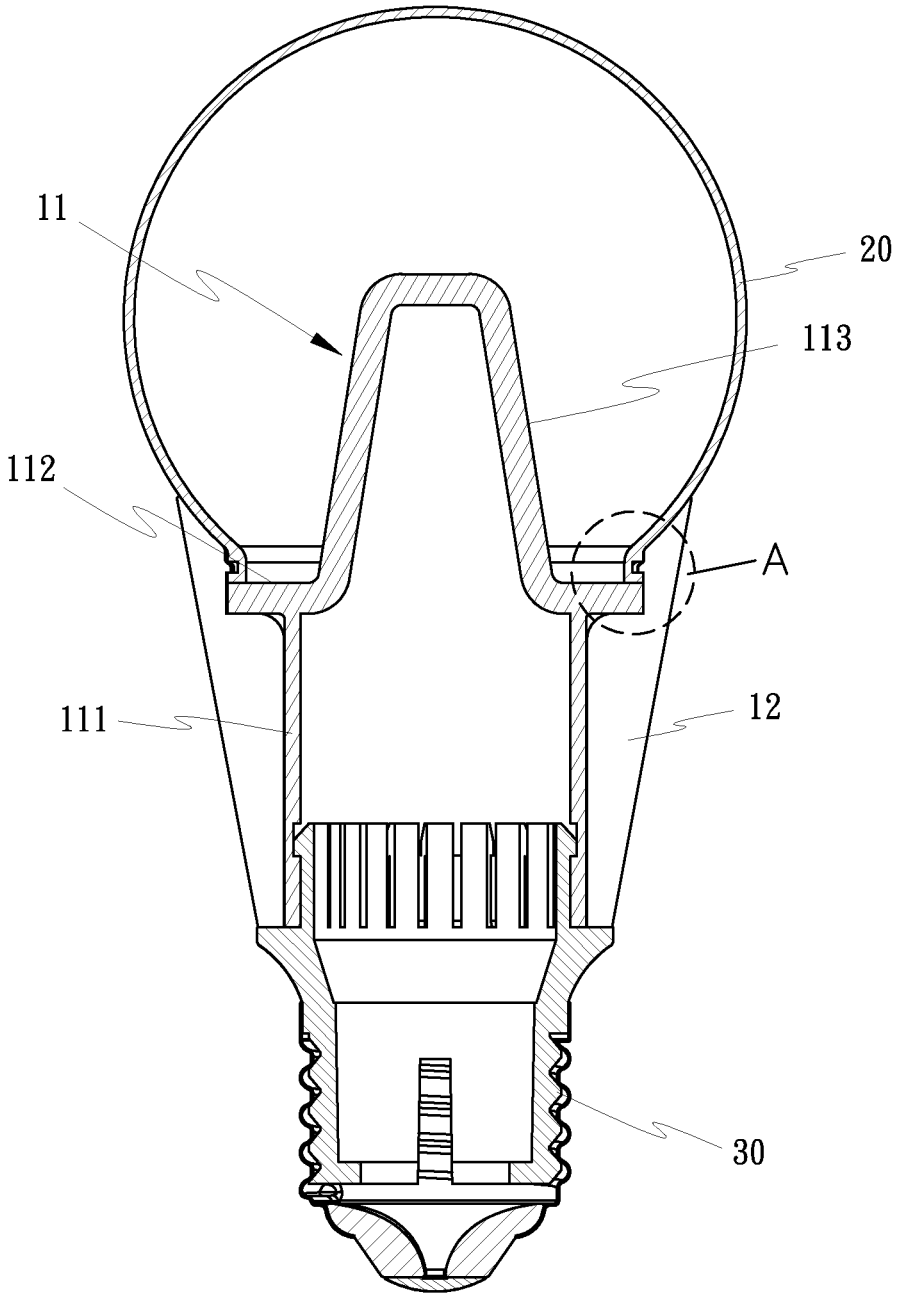
FIG. 9 is a schematic sectional view of an omnidirectional LED lamp holder assembly in accordance with a third embodiment of the present invention.
Figure 10:
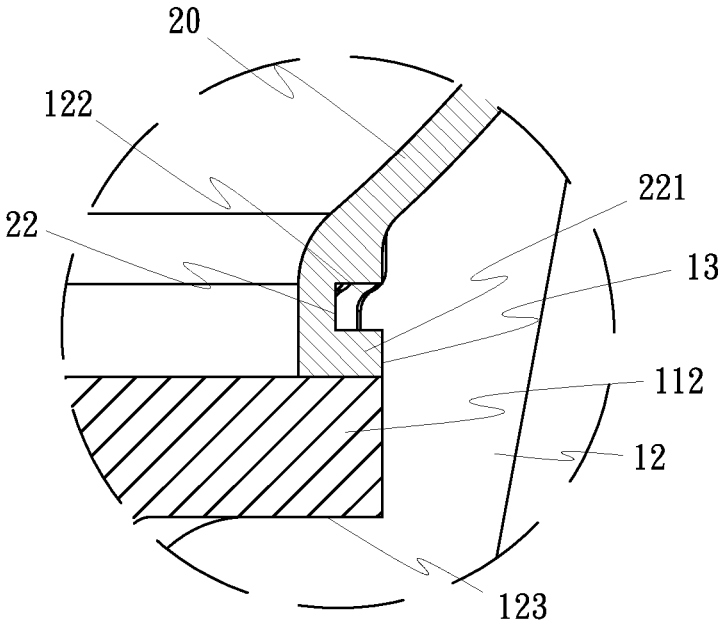
FIG. 10 is an enlarged view of Part A in FIG. 9.

FIGS. 9 and 10 illustrate an omnidirectional LED lamp holder assembly in accordance with a third embodiment of the present invention. According to this third embodiment, the heat sink module 10 is a one-piece extruded member, i.e., the tubular heat-transfer base portion 111, the broad platform 112 and the hollow protruding mount 113 are formed integrally; the connection structure between the electrical connector 30 and the heat-transfer base portion 111 is the same as that of the aforesaid first embodiment. The main feature of this third embodiment is that the lampshade 20 is directly fastened to the radiation fins 12 of the heat sink base 10. According to this third embodiment, the lampshade 20 comprises an outside annular groove 22 extending around the periphery near the bottom edge thereof; each radiation fin 12 comprises a retaining protruding portion 122. The retaining protruding portions 122 of the radiation fins 12 constitute an interrupted flange around the radiation fins 12. The lampshade 20 is fastened to the radiation fins 12 by forcing the interrupted flange of thee retaining protruding portions 122 into engagement with the outside annular groove 22 of the lampshade 20. Further, in order to enhance connection stability between the lampshade 20 and the radiation fins 12, each radiation fin 12 is configured to provide a step 123 at an inner upper side thereof. The steps 123 of the radiation fins 12 constitute a support for the bearing face 1121 of the broad platform 112 of the heat sink base 11 of the heat sink module 10. The bearing face 1121 is disposed above the support that is formed of the steps 123 of the radiation fins 12, and a gap 13 is defined between the top wall of the broad platform 112 and the interrupted flange of the retaining protruding portions 122 of the radiation fins 12. The bottom wall 221 of the annular groove 22 of the lampshade 20 is supported on the top wall of the broad platform 112 and press-fitted into the gap 13 to enhance connection tightness between the lampshade 20 and the radiation fins 12.

Figure 11:
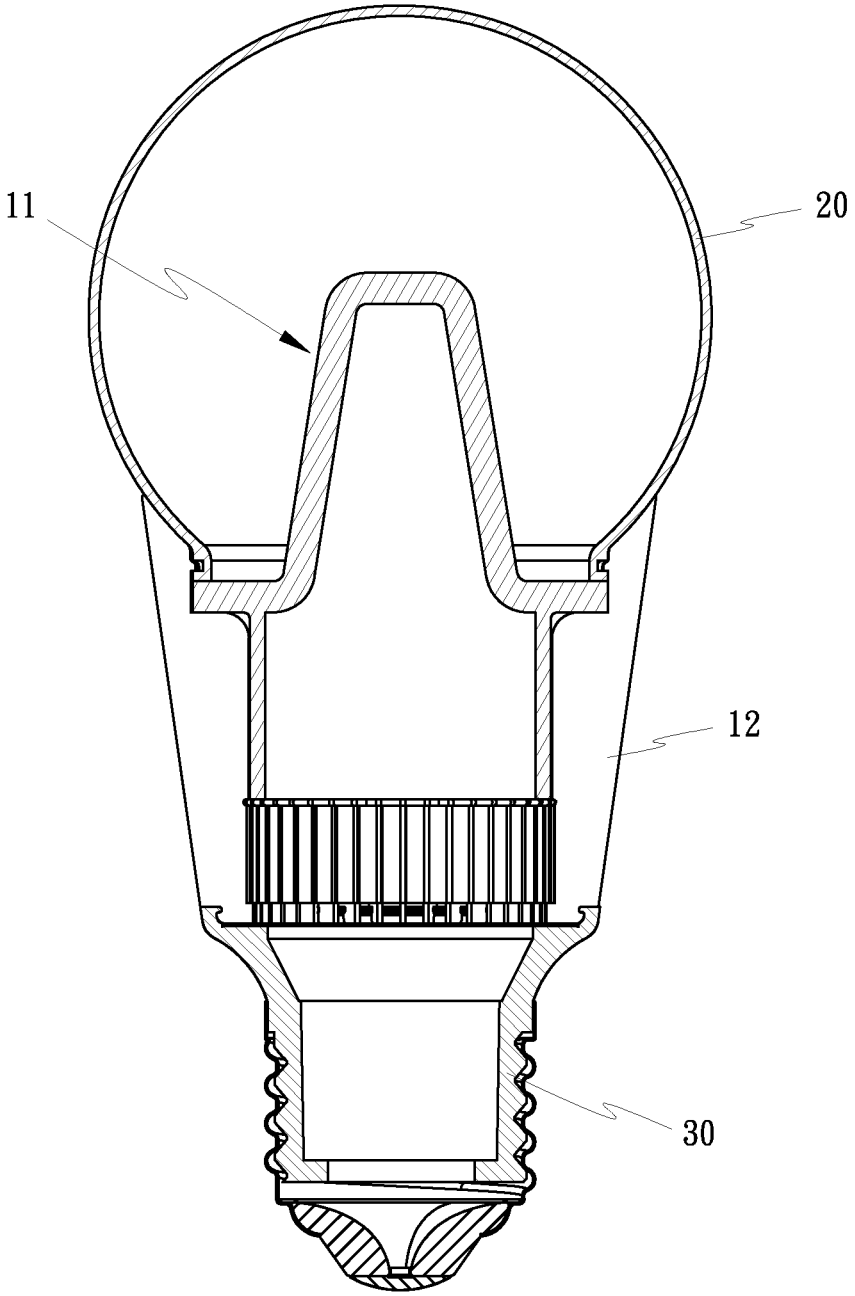
FIG. 11 is a schematic sectional view of an omnidirectional LED lamp holder assembly in accordance with a fourth embodiment of the present invention.

Further, FIG. 11 illustrates an omnidirectional LED lamp holder assembly in accordance with a fourth embodiment of the present invention. According to this fourth embodiment, the connection structure between the lampshade 20 and the radiation fins 12 is the same as the aforesaid third embodiment, and the connection structure between the electrical connector 30 and the radiation fins 12 is the same as the aforesaid second embodiment.

In conclusion, the invention is characterized in that the heat sink base of the heat sink module is a one-piece extruded member defining a heat-transfer base portion, a broad platform and a hollow protruding mount; the hollow protruding mount is configured to support a plurality of LED chips in different angles; the radiation fins are radially arranged around the heat-transfer base portion of the heat sink base for dissipation heat rapidly; the wall thickness of the heat-transfer base portion and the wall thickness of the hollow protruding mount can be selectively configured according to the power of the LED chips to be installed in order to enhance the heat dissipation efficiency and to facilitate processing and production.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An omnidirectional LED lamp holder assembly, comprising a heat sink module comprising a heat sink base and a plurality of radiation fins mounted around said heat sink base, a lampshade mounted at a top side of said heat sink module, and an electrical connector mounted at a bottom side of said heat sink module opposite to said lampshade, wherein: said heat sink base is a one-piece extruded member comprising a tubular heat-transfer base portion, a broad platform and a hollow protruding mount for the mounting of LED chip, said broad platform being integrally connected to one end of said tubular heat-transfer base portion and defining a bearing face that protrudes horizontally over the periphery of said tubular heat-transfer base portion, said hollow protruding mount being integrally connected to and upwardly extended from a center area of a top wall of said broad platform, said hollow protruding mount comprising a horizontal top wall and a plurality of upright sidewalls connected between the periphery of said horizontal top wall and said broad platform at different angles and defining with said horizontal top wall a cavity, said tubular heat-transfer base portion defining therein a tubular chamber disposed in communication with said cavity and a plurality of longitudinal mounting grooves equally spaced around the periphery thereof; said radiation fins are respectively and radially fastened to said longitudinal mounting grooves of said tubular heat-transfer base portion, and wherein:

said broad platform comprises an annular retaining groove extending around the periphery thereof, said lampshade comprises an annular mounting rib protruding from an inside wall thereof and engaged into said annular retaining groove of said broad platform; and said longitudinal mounting grooves of said tubular heat-transfer base portion are simultaneously formed on the periphery of said tubular heat-transfer base portion upon extrusion of said heat sink base to form said tubular heat-transfer base portion, said broad platform and said hollow protruding mount all in one piece.

2. The omnidirectional LED lamp holder assembly as claimed in claim 1, wherein said tubular heat-transfer base portion, said horizontal top wall and said upright sidewalls of said hollow protruding mount have different wall thicknesses.

3. The omnidirectional LED lamp holder assembly as claimed in claim 2, wherein the wall thickness of said tubular heat-transfer base portion is smaller than the wall thickness of said horizontal top wall of said hollow protruding mount and the wall thickness of said upright sidewall of said hollow protruding mount.

4. The omnidirectional LED lamp holder assembly as claimed in claim 1, wherein said lampshade comprises an annular groove extending around the periphery thereof; said radiation fins each comprise a retaining protruding portion, the retaining protruding portions of said radiation fins constituting an interrupted flange around said radiation fins and engaged into said annular groove of said lampshade.

5. The omnidirectional LED lamp holder assembly as claimed in claim 4, wherein said radiation fins each further comprise a step located at an inner upper side thereof; said bearing face of said broad platform is supported on the steps of said radiation fins and a gap is defined between the top wall of the broad platform and the retaining protruding portions of said radiation fins; said lampshade defines a bottom wall at a bottom side of the annular groove thereof and press-fitted into said gap.

6. The omnidirectional LED lamp holder assembly as claimed in claim 1, wherein said electrical connector is fastened to said tubular heat-transfer base portion; said tubular heat-transfer base portion comprises an annular groove extending around an inside wall thereof and an anti-rotation groove having one end thereof extending across the annular groove of said tubular heat-transfer base portion and an opposite end thereof extending to a bottom edge of said tubular heat-transfer base portion; said electrical connector comprises a top opening and a plurality of hook rods and an anti-rotation rod arranged around said top opening, each said hook rod having a top end thereof terminating in an outer hook portion and hooked in the annular groove of said tubular heat-transfer base portion, said anti-rotation rod having a free distal end and being engaged into said anti-rotation groove.

7. The omnidirectional LED lamp holder assembly as claimed in claim 1, wherein said electrical connector is fastened to said radiation fins; each said radiation fin defines a retaining notch at an outer lower side thereof; said electrical connector comprises a top opening and a plurality of hook rods arranged around said top opening, each said hook rod having a top end thereof terminating in an inner hook portion and hooked in said retaining notch of one said radiation fin.

8. A heat sink module for omnidirectional LED lamp holder assembly, comprising a heat sink base and a plurality of radiation fins mounted around said heat sink base, wherein: said heat sink base is a one-piece extruded member comprising a tubular heat-transfer base portion, a broad platform and a hollow protruding mount for the mounting of LED chip, said broad platform being integrally connected to one end of said tubular heat-transfer base portion and defining a bearing face that protrudes horizontally over the periphery of said tubular heat-transfer base portion, said hollow protruding mount being integrally connected to and upwardly extended from a center area of a top wall of said broad platform, said hollow protruding mount defining a horizontal top wall and a plurality of upright sidewalls connected between the periphery of said horizontal top wall and said broad platform at different angles and defining with said horizontal top wall a cavity, said tubular heat-transfer base portion defining therein a tubular chamber disposed in communication with said cavity and a plurality of longitudinal mounting grooves equally spaced around the periphery thereof; said radiation fins are respectively and radially fastened to said longitudinal mounting grooves of said tubular heat-transfer base portion, and wherein:

said longitudinal mounting groove is simultaneously formed on the periphery of said tubular heat-transfer base portion upon extrusion of said heat sink base to form said tubular heat-transfer base portion, said broad platform and said hollow protruding mount all in one piece.

9. The heat sink module for omnidirectional LED lamp holder assembly as claimed in claim 8, wherein said broad platform comprises an annular retaining groove extending around the periphery thereof.

10. The heat sink module for omnidirectional LED lamp holder assembly as claimed in claim 8, wherein said tubular heat-transfer base portion comprises an annular groove extending around an inside wall thereof and an anti-rotation groove having one end thereof extending across the annular groove of said tubular heat-transfer base portion and an opposite end thereof extending to a bottom edge of said tubular heat-transfer base portion.

11. The heat sink module for omnidirectional LED lamp holder assembly as claimed in claim 8, wherein said radiation fins each comprise a retaining protruding portion, the retaining protruding portions of said radiation fins constituting an interrupted flange around said radiation fins.

12. The heat sink module for omnidirectional LED lamp holder assembly as claimed in claim 8, wherein said radiation fins each define a retaining notch at an outer lower side thereof.

13. An omnidirectional LED lamp holder assembly, comprising a heat sink module comprising a heat sink base and a plurality of radiation fins mounted around said heat sink base, a lampshade mounted at a top side of said heat sink module, and an electrical connector mounted at a bottom side of said heat sink module opposite to said lampshade, wherein: said heat sink base is a one-piece extruded member comprising a tubular heat-transfer base portion, a broad platform and a hollow protruding mount for the mounting of LED chip, said broad platform being integrally connected to one end of said tubular heat-transfer base portion and defining a bearing face that protrudes horizontally over the periphery of said tubular heat-transfer base portion, said hollow protruding mount being integrally connected to and upwardly extended from a center area of a top wall of said broad platform, said hollow protruding mount comprising a horizontal top wall and a plurality of upright sidewalls connected between the periphery of said horizontal top wall and said broad platform at different angles and defining with said horizontal top wall a cavity, said tubular heat-transfer base portion defining therein a tubular chamber disposed in communication with said cavity and a plurality of longitudinal mounting grooves equally spaced around the periphery thereof; said radiation fins are respectively and radially fastened to said longitudinal mounting grooves of said tubular heat-transfer base portion, and wherein:

said electrical connector is fastened to said tubular heat-transfer base portion; said tubular heat-transfer base portion comprises an annular groove extending around an inside wall thereof and an anti-rotation groove having one end thereof extending across the annular groove of said tubular heat-transfer base portion and an opposite end thereof extending to a bottom edge of said tubular heat-transfer base portion; said electrical connector comprises a top opening and a plurality of hook rods and an anti-rotation rod arranged around said top opening, each said hook rod having a top end thereof terminating in an outer hook portion and hooked in the annular groove of said tubular heat-transfer base portion, said anti-rotation rod having a free distal end and being engaged into said anti-rotation groove.

* * * * *